US011085681B2

(12) United States Patent
Zha

(10) Patent No.: US 11,085,681 B2
(45) Date of Patent: Aug. 10, 2021

(54) COOLING SYSTEM

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 106 days.

(21) Appl. No.: 16/270,148

(22) Filed: Feb. 7, 2019

(65) Prior Publication Data

US 2020/0256602 A1 Aug. 13, 2020

(51) Int. Cl.

| | |
|---|---|
| ***F25B 49/02*** | (2006.01) |
| ***F25B 9/00*** | (2006.01) |
| ***F25B 31/00*** | (2006.01) |
| ***F25B 40/04*** | (2006.01) |

(52) U.S. Cl.

CPC ..... *F25B 49/02* (2013.01); *F25B 9/008* (2013.01); *F25B 31/004* (2013.01); *F25B 40/04* (2013.01); *F25B 2500/26* (2013.01)

(58) Field of Classification Search

CPC ..... F25B 49/02; F25B 9/008; F25B 40/04; F25B 31/004; F25B 2500/26; F25B 2313/0234; F25B 2313/0252

See application file for complete search history.

(56) References Cited

U.S. PATENT DOCUMENTS 5,822,999 A * 10/1998 Salo ..... F25B 41/04 62/196.3
2005/0150248 A1* 7/2005 Manole ..... F25B 41/067 62/513
2007/0220915 A1* 9/2007 Heyl ..... F25B 1/10 62/324.1

(Continued)

FOREIGN PATENT DOCUMENTS

EP 2754980 A1 7/2014
JP S5495050 A * 7/1979

(Continued)

OTHER PUBLICATIONS

Kimura, Refrigerating Apparatus, Mar. 11, 1992, JPH0476357A, Whole Document (Year: 1992).*

(Continued)

*Primary Examiner* — Larry L Furdge
(74) *Attorney, Agent, or Firm* — Baker Botts L.L.P.

(57) ABSTRACT

An apparatus includes a high side heat exchanger, a heat exchanger, a flash tank, a first expansion valve, a second expansion valve, a load, a first compressor, and a second compressor. During a first mode of operation, the second expansion valve directs refrigerant from the flash tank to the load. The refrigerant from the load bypasses the first compressor. The heat exchanger transfers heat from the refrigerant from the high side heat exchanger to the refrigerant from the load. The second compressor compresses the refrigerant from the heat exchanger. During a second mode (Continued)

of operation, the first expansion valve directs refrigerant from the flash tank to the load. The first compressor compresses the refrigerant from the load and the second compressor compresses the refrigerant from the first compressor before the refrigerant from the first compressor reaches the high side heat exchanger.

20 Claims, 3 Drawing Sheets

(56) References Cited

U.S. PATENT DOCUMENTS

| | | | | |
|---|---|---|---|---|
| 2010/0251756 | A1* | 10/2010 | Scarcella | F25B 31/002 62/457.9 |
| 2012/0167601 | A1* | 7/2012 | Cogswell | F25B 41/00 62/115 |
| 2018/0156513 | A1 | 6/2018 | Javerschek | |

FOREIGN PATENT DOCUMENTS

| | | | | |
|---|---|---|---|---|
| JP | H0476357 | A | * | 3/1992 |
| WO | 2011054397 | A1 | | 5/2011 |
| WO | 2014100330 | A1 | | 6/2014 |

OTHER PUBLICATIONS

Suzuki, Air Conditioner, Jul. 27, 1979, JPS5495050A, Whole Document (Year: 1979).*

Finn et al, A Transcritical Refrigeration System With a Booster, Feb. 21, 2008, WO2008/019689A2, Whole Document (Year: 2008).*

European Patent Office, Extended European Search Report, Application No. 20153741.2, dated Jul. 10, 2020, 6 pages.

* cited by examiner

COOLING SYSTEM

TECHNICAL FIELD

This disclosure relates generally to a cooling system.

BACKGROUND

Cooling systems are used to cool spaces, such as cold storage units and blast freezers. These systems cycle a refrigerant (also referred to as charge) that is used to cool the spaces.

SUMMARY

Cooling systems, such as cold storage units and blast freezers, are used to cool spaces. These systems cycle a refrigerant (e.g., carbon dioxide) that is used to cool a space. The refrigerant is used by a load to cool a space proximate the load. For example, a cold storage unit and a blast freezer may use the refrigerant to cool a space within the cold storage unit and blast freezer. The refrigerant is then compressed by a compressor to concentrate the heat absorbed in the refrigerant at the load so that the heat is more easily removed. A problem, however, occurs at system startup. Because the temperature of the space that is to be cooled is typically at its highest at startup, the system works the hardest at startup to cool the space. As a result, the refrigerant at the load absorbs the most heat at startup and the pressure of the refrigerant increases, sometimes so rapidly that it causes the compressor to shut down.

This disclosure contemplates an unconventional cooling system that reduces the chances that a compressor shuts down during startup in certain embodiments. At startup, the refrigerant used to cool the load is directed to a first compressor that is designed to compress refrigerant used to cool a space to higher temperatures (e.g., refrigeration temperatures). After the space is cooled to a particular temperature (e.g., 10 degrees Fahrenheit), the system transitions to post-startup to cool the space to even lower temperatures (e.g., blast freezing temperatures). During post-startup, the refrigerant from the load is first compressed by a second compressor that is designed to compress refrigerant used to cool a space to these lower temperatures. The first compressor then compresses the refrigerant from the second compressor. In this manner, the second compressor is protected from shutting down during startup. Certain embodiments of the cooling system are discussed below.

According to an embodiment, an apparatus includes a high side heat exchanger, a heat exchanger, a flash tank, a first expansion valve, a second expansion valve, a load, a first compressor, and a second compressor. The high side heat exchanger removes heat from a refrigerant. The flash tank stores the refrigerant. During a first mode of operation, the first expansion valve is closed and the second expansion valve directs refrigerant from the flash tank to the load. The load uses the refrigerant from the second expansion valve to cool a space proximate the load and the first compressor is off. The refrigerant from the load bypasses the first compressor. The heat exchanger transfers heat from the refrigerant from the high side heat exchanger to the refrigerant from the load and directs the refrigerant from the load to the second compressor after heat from the refrigerant from the high side heat exchanger is transferred to the refrigerant from the load. The second compressor compresses the refrigerant from the heat exchanger. During a second mode of operation, the first expansion valve directs refrigerant from the flash tank to the load and the second expansion valve is closed. The load uses the refrigerant from the first expansion valve to cool the space and the first compressor compresses the refrigerant from the load. The heat exchanger is off and the second compressor compresses the refrigerant from the first compressor before the refrigerant from the first compressor reaches the high side heat exchanger.

According to another embodiment, a method includes removing, by a high side heat exchanger, heat from a refrigerant and storing, by a flash tank, the refrigerant. During a first mode of operation, the method includes directing, by a first expansion valve, refrigerant from the flash tank to a load and using, by the load, the refrigerant from the first expansion valve to cool a space proximate the load. The refrigerant from the load bypasses a first compressor. The method also includes transferring, by a heat exchanger, heat from the refrigerant from the high side heat exchanger to the refrigerant from the load, directing, by the heat exchanger, the refrigerant from the load to a first compressor after heat from the refrigerant from the high side heat exchanger is transferred to the refrigerant from the load, and compressing, by the first compressor, the refrigerant from the heat exchanger. During a second mode of operation, the method includes directing, by a second expansion valve, refrigerant from the flash tank to the load and using, by the load, the refrigerant from the second expansion valve to cool the space. The method also includes compressing, by a second compressor, the refrigerant from the load and compressing, by the first compressor, the refrigerant from the second compressor before the refrigerant from the second compressor reaches the high side heat exchanger.

According to yet another embodiment, a system includes a high side heat exchanger, a flash tank, a first expansion valve, a second expansion valve, a load, a valve, a first compressor, and a second compressor. The high side heat exchanger removes heat from a refrigerant. The flash tank stores the refrigerant. During a first mode of operation, the first expansion valve is closed and the second expansion valve directs refrigerant from the flash tank to the load. The load uses the refrigerant from the second expansion valve to cool a space proximate the load and the first compressor is off. The valve directs the refrigerant from the load to the heat exchanger bypassing the first compressor and the heat exchanger transfers heat from the refrigerant from the high side heat exchanger to the refrigerant from the load. The heat exchanger directs the refrigerant from the load to the second compressor after heat from the refrigerant from the high side heat exchanger is transferred to the refrigerant from the load and the second compressor compresses the refrigerant from the heat exchanger. During a second mode of operation, the first expansion valve directs refrigerant from the flash tank to the load and the second expansion valve is closed. The load uses the refrigerant from the first expansion valve to cool the space and the first compressor compresses the refrigerant from the load. The heat exchanger is off and the second compressor compresses the refrigerant from the first compressor before the refrigerant from the first compressor reaches the high side heat exchanger.

Certain embodiments provide one or more technical advantages. For example, an embodiment protects a compressor from shutting down during startup. As another example, an embodiment provides stable operation and control with one rack. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
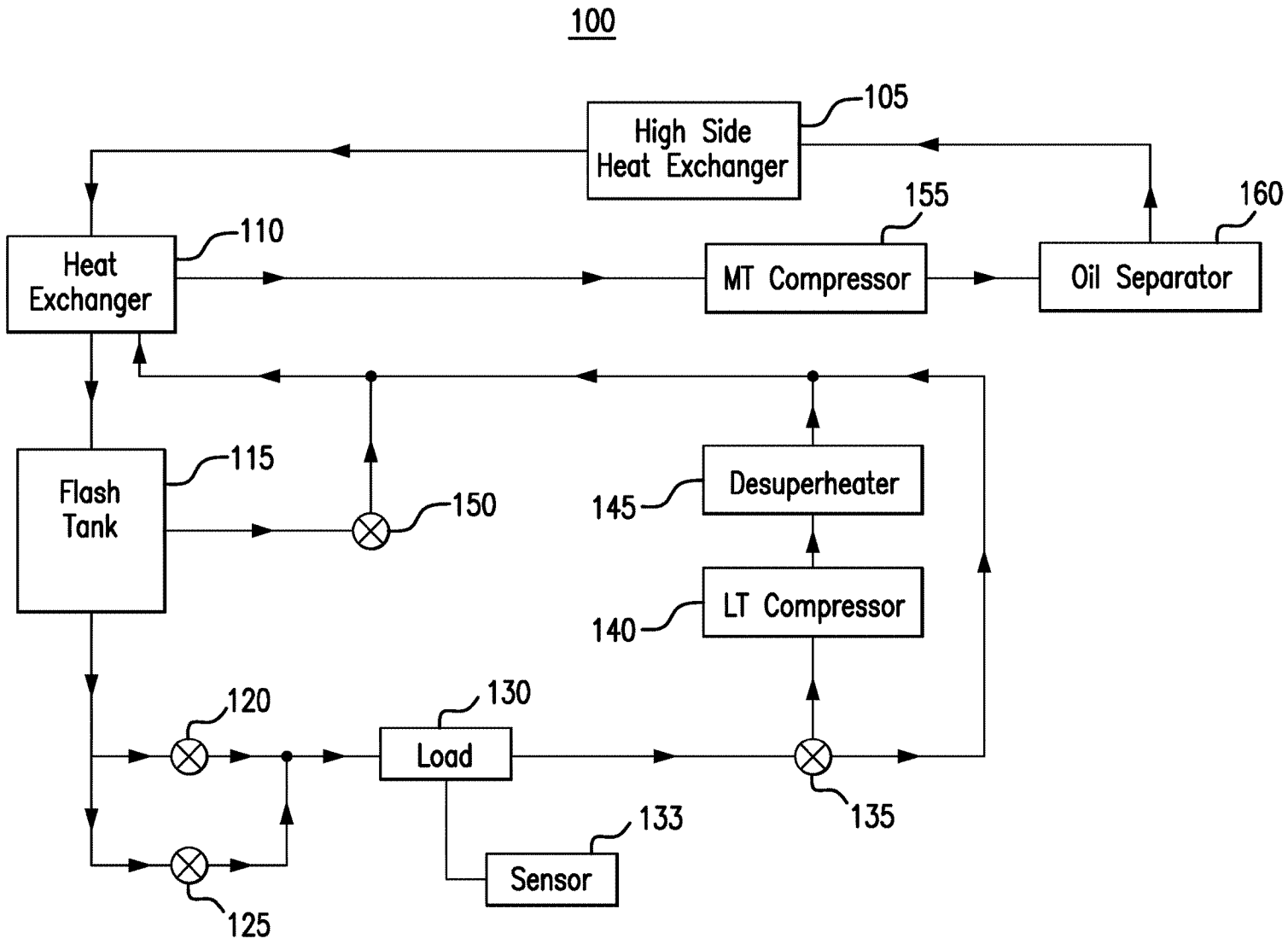
FIG. 1 illustrates an example cooling system.
Figure 2:
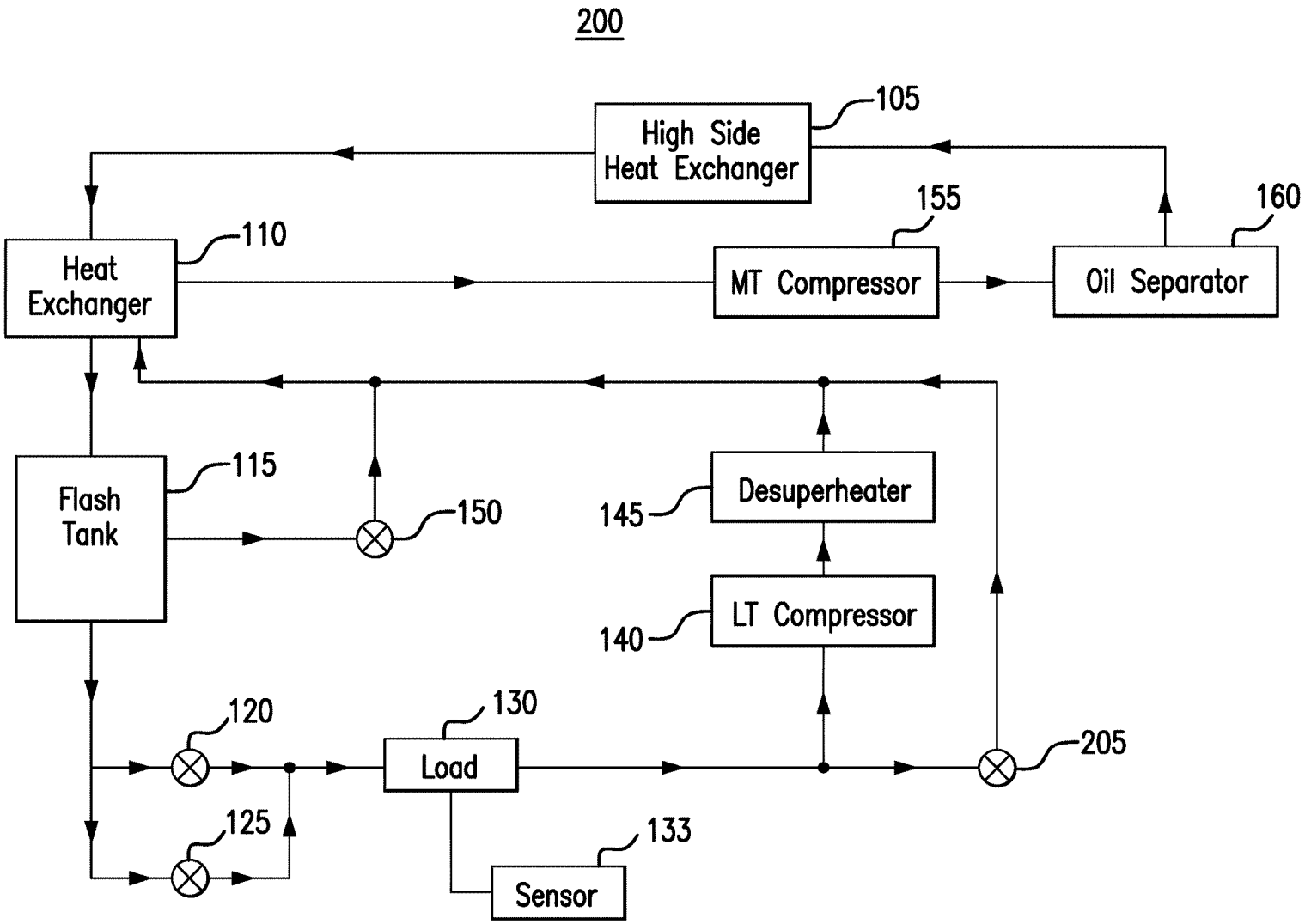
FIG. 2 illustrates an example cooling system.
Figure 3:
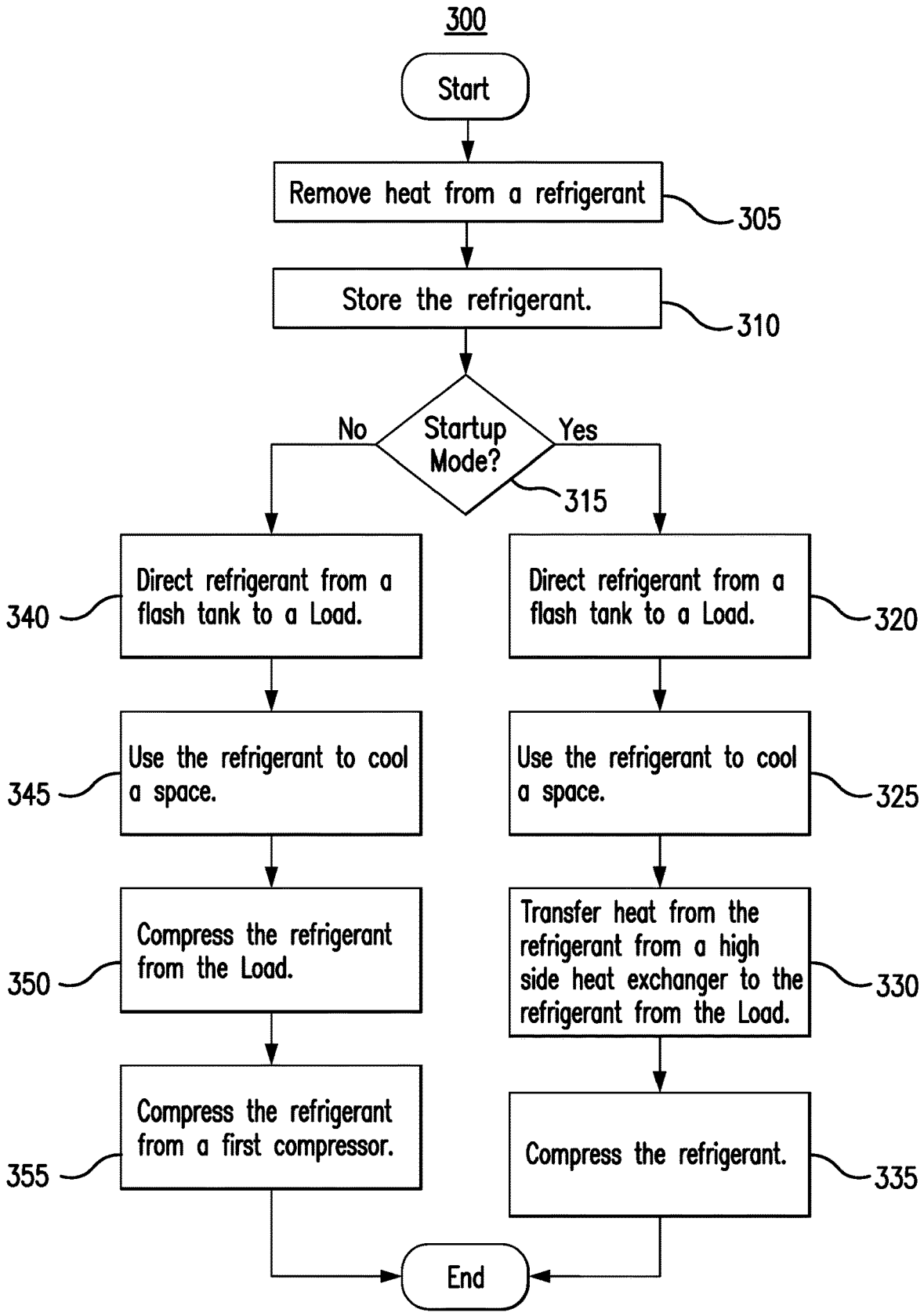
FIG. 3 is a flowchart illustrating a method of operating an example cooling system.

Embodiments of the present disclosure and its advantages are best understood by referring to FIGS. 1 through 3 of the drawings, like numerals being used for like and corresponding parts of the various drawings.

Cooling systems, such as cold storage units and blast freezers, are used to cool spaces. These systems cycle a refrigerant (e.g., carbon dioxide) that is used to cool a space. The refrigerant is used by a load to cool a space proximate the load. For example, a cold storage unit and a blast freezer may use the refrigerant to cool a space within the cold storage unit and blast freezer. The refrigerant is then compressed by a compressor to concentrate the heat absorbed in the refrigerant at the load so that the heat is more easily removed. A problem, however, occurs at system startup. Because the temperature of the space that is to be cooled is typically at its highest at startup, the system works the hardest at startup to cool the space. As a result, the refrigerant at the load absorbs the most heat at startup and the pressure of the refrigerant increases, sometimes so rapidly that it causes the compressor to shut down.

This disclosure contemplates an unconventional system that reduces the chances that a compressor shuts down during startup in certain embodiments. At startup, the refrigerant used to cool the load is directed to a first compressor that is designed to compress refrigerant used to cool a space to higher temperatures (e.g., refrigeration temperatures). After the space is cooled to a particular temperature (e.g., 10 degrees Fahrenheit), the system transitions to post-startup to cool the space to even lower temperatures (e.g., blast freezing temperatures). During post-startup, the refrigerant from the load is first compressed by a second compressor that is designed to compress refrigerant used to cool a space to these lower temperatures. The first compressor then compresses the refrigerant from the second compressor. In this manner, the second compressor is protected from shutting down during startup. The cooling system will be described in more detail using FIGS. 1 through 3.

FIG. 1 illustrates an example cooling system 100. As seen in FIG. 1, cooling system 100 includes a high side heat exchanger 105, a heat exchanger 110, a flash tank 115, an expansion valve 120, an expansion valve 125, a load 130, a sensor 133, a valve 135, a low temperature compressor 140, a desuperheater 145, a valve 150, a medium temperature compressor 155, and an oil separator 160. Generally, system 100 protects low temperature compressor 140 from shutting down during start up by directing refrigerant from load 130 to medium temperature compressor 155, bypassing low temperature compressor 140. When a temperature of load 130 is below a threshold, system 100 begins directing refrigerant from load 130 to low temperature compressor 140. As a result, low temperature compressor 140 is protected from startup operating conditions in certain embodiments.

Generally, system 100 cycles a refrigerant to cool load 130 and/or a space proximate load 130. The refrigerant absorbs heat from load 130 and/or space proximate load 130. The refrigerant is then compressed so that the heat is more easily removed from the refrigerant. As seen in system 100, the refrigerant from load 130 may be compressed by low temperature compressor 140 and/or medium temperature compressor 155. These two compressors, however, may be designed to compress refrigerant that was used to cool spaces to different temperatures. For example, medium temperature compressor 155 may be designed to compress refrigerant that was used to cool a space to refrigeration temperatures, and low temperature compressor 140 may be designed to compress refrigerant that was used to cool a space to freezer temperatures. In some designs, medium temperature compressor 155 may compress a mixture of a refrigerant that was used to cool a space to refrigeration temperatures and a refrigerant that was used to cool a space to freezer temperatures. At the startup of system 100, load 130 is at its highest temperature. Thus, refrigerant leaving load 130 is at its highest temperature and/or pressure. The temperature and/or pressure of the refrigerant may be too high for low temperature compressor 140 to compress. If that refrigerant is directed to low temperature compressor 140, then low temperature compressor 140 may shut down causing system 100 to malfunction.

This disclosure protects low temperature compressor 140 from shutting down during startup by directing the refrigerant from load 130 to medium temperature compressor 155 bypassing low temperature compressor 140. After load 130 has been cooled to a particular threshold temperature, for example 10 degrees Fahrenheit, system 100 transition to a post-startup mode and allows refrigerant from load 130 to flow to low temperature compressor 140. In this manner, low temperature compressor 140 is not tasked with compressing the refrigerant from load 130 during startup. The various components of system 100 are described below.

High side heat exchanger 105 removes heat from a refrigerant (e.g., carbon dioxide). When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building. This disclosure contemplates any suitable refrigerant (e.g., carbon dioxide) being used in any of the disclosed cooling systems.

Heat exchanger 110 transfers heat between two fluids flowing through heat exchanger 110. In the example of FIG. 1, heat exchanger 110 transfers heat from a refrigerant from high side heat exchanger 105 to a refrigerant from load 130. During startup, the refrigerant from load 130 bypasses low temperature compressor 140 and flows through heat exchanger 110. Heat exchanger 110 transfers heat from the refrigerant from high side heat exchanger 105 to the refrigerant from load 130. In this manner, the refrigerant going to flash tank 115 is further cooled and additional superheat is added to the refrigerant going to medium temperature compressor 155. After the heat transfer is complete, heat exchanger 110 directs the refrigerant from high side heat exchanger 105 to flash tank 115 and the refrigerant from load 130 to medium temperature compressor 155. After system 100 has finished starting up, heat exchanger 110 may be shut off. When heat exchanger 110 is shut off, refrigerant can continue to flow through heat exchanger 110, but heat exchanger 110 will not transfer heat between refrigerant flowing through heat exchanger 110.

Flash tank 115 stores refrigerant received from high side heat exchanger 105. This disclosure contemplates flash tank 115 storing refrigerant in any state such as, for example, a liquid state and/or a gaseous state. Refrigerant leaving flash tank 115 is fed to low temperature load 120 and medium temperature load 115. In some embodiments, a flash gas and/or a gaseous refrigerant is released from flash tank 115. By releasing flash gas, the pressure within flash tank 115 may be reduced.

Expansion valves 120 and 125 control a flow of refrigerant. For example, when expansion valve 120 or 125 is opened, refrigerant flows through expansion valve 120 or 125. When expansion valve 120 or 125 is closed, refrigerant stops flowing through expansion valve 120 or 125. In certain embodiments, expansion valve 120 or 125 can be opened to varying degrees to adjust the amount of flow of refrigerant. For example, expansion valve 120 or 125 may be opened more to increase the flow of refrigerant. As another example, expansion valve 120 or 125 may be opened less to decrease the flow of refrigerant. Thus, expansion valve 120 or 125 directs refrigerant from flash tank 115 to load 130.

Expansion valve 120 or 125 is used to cool refrigerant flowing through expansion valve 120 or 125. Expansion valve 120 or 125 may receive refrigerant from any component of system 200 such as for example flash tank 115. Expansion valve 120 or 125 reduces the pressure and therefore the temperature of the refrigerant. The temperature of the refrigerant may then drop as pressure is reduced. As a result, refrigerant entering expansion valve 120 or 125 may be cooler when leaving expansion valve 120 or 125. Expansion valve 120 and expansion valve 125 cool refrigerant to different temperatures in certain embodiments. For example, expansion valve 120 may cool refrigerant to a higher temperature than expansion valve 125. As a result, refrigerant from expansion valve 120 cools load 130 to a higher temperature than refrigerant from expansion valve 125. In other embodiments, expansion valves 120 and 125 may be designed to handle different volumes of refrigerant. For example, expansion valve 125 may be designed to reduce the temperature of a larger volume of refrigerant per unit time than expansion valve 120.

In particular embodiments, expansion valve 120 is used in system 100 during startup and expansion valve 125 is used after startup is complete. During startup, refrigerant from flash tank 115 flows through expansion valve 120. Expansion valve 125 is closed. Expansion valve 120 cools the refrigerant and directs the cold refrigerant to load 130. The refrigerant cools load 130 to a particular temperature. When load 130 has cooled to that temperature, system 100 transitions to a post-startup mode. During the post-startup mode, expansion valve 120 closes and expansion valve 125 opens. Refrigerant flows from flash tank 115 through expansion valve 125. Expansion valve 125 cools the refrigerant to a colder temperature than expansion valve 120. The cooled refrigerant from expansion valve 125 is directed to load 130. Load 130 then uses the refrigerant from expansion valve 125 to further cool load 130 to even colder temperatures.

Load 130 uses refrigerant to cool load 130 or a space proximate load 130. For example, load 130 may be a blast freezer that uses the refrigerant to cool an internal space of the blast freezer and/or an object within the blast freezer. Refrigerant flows from flash tank 115 to load 130. When the refrigerant reaches load 130, the refrigerant removes heat from the air around load 130. As a result, the air is cooled. The cooled air may then be circulated such as, for example, by a fan to cool a space such as, for example, an internal space of load 130. As refrigerant passes through load 130, the refrigerant may change from a liquid state to a gaseous state as it absorbs heat. This disclosure contemplates including any number of loads 130 in any of the disclosed cooling systems.

Load 130 may be a cold storage unit and/or a blast freezer. During startup, load 130 uses refrigerant from expansion valve 120 to cool load 130 to a particular temperature, such as, for example, 10 degrees Fahrenheit. When load 130 has reached the particular temperature, load 130 begins using refrigerant from expansion valve 125 to further cool load 130.

Sensor 133 is any suitable sensor for detecting a temperature of load 130. For example, if load 130 is a blast freezer, sensor 133 may detect a temperature within the blast freezer and/or of an object within the blast freezer. When sensor 133 detects that the temperature of load 130 has reached a particular threshold, such as, for example, 10 degrees Fahrenheit, system 100 may end the startup mode and transition to post-startup mode.

Valve 135 is a three-way valve that directs refrigerant from load 130 to low temperature compressor 140 or heat exchanger 110. During startup, valve 135 receives refrigerant from load 130 and directs that refrigerant to heat exchanger 110, bypassing low temperature compressor 140. During post-startup, valve 135 receives refrigerant from load 130 and directs that refrigerant to low temperature compressor 140. In this manner, valve 135 controls the flow of refrigerant during startup and post-startup.

Low temperature compressor 140 compresses refrigerant from load 130 during post-startup. During startup, low temperature compressor 140 may be kept off. By compressing the refrigerant from load 130, low temperature compressor 140 concentrates the heat absorbed by the refrigerant at load 130, thus making it easier to remove the heat from the refrigerant as discussed previously. Low temperature compressor 140 does not compress refrigerant from load 130 during startup, because low temperature compressor 140 may shut down if tasked with compressing the refrigerant from load 130 during startup.

Desuperheater 145 removes heat from the refrigerant from low temperature compressor 140. Desuperheater 145 may include metallic tubes, plates and/or fins that act as heat exchangers. Desuperheater 145 may also include one or more fans that circulate air over the metallic components. As a result, heat from the refrigerant flowing through the metallic components is transferred to the ambient air, thereby removing heat from the refrigerant in desuperheater 145. Particular embodiments of system 100 may not include desuperheater 145.

Flash gas bypass valve controls the flow of a flash gas discharged by flash tank 115. For example, flash gas bypass valve 150 can be opened to allow flash gas to flow from flash tank 110 to medium temperature compressor 155. Flash gas bypass valve 150 may be closed to stop the flow of flash gas in flash tank 115. Thus, flash gas bypass valve 150 can be used to regulate and/or maintain an internal pressure of flash tank 115. For example, by releasing flash gas from flash tank 115, the internal pressure of flash tank 115 may be reduced. In some embodiments, flash gas bypass valve 150 may be used to control a temperature and/or superheat of a refrigerant from load 130. For example, during post-startup, flash gas bypass valve 150 may be opened to allow flash gas to mix with the refrigerant from load 130 and/or low temperature compressor 140. As a result, that refrigerant may be cooled before reaching medium temperature compressor 155.

Medium temperature compressor 155 compresses a refrigerant from load 130. Medium temperature compressor 155 may be designed to compress a refrigerant that is used to cool a space to a higher temperature than refrigerant that low temperature compressor 140 was designed to compress. During startup, medium temperature compressor 155 compresses refrigerant from load 130 after the refrigerant has passed through heat exchanger 110. As discussed previously, while passing through heat exchanger 110 during startup, the refrigerant may absorb heat from refrigerant from high side heat exchanger 105. In this manner, the refrigerant may contain enough superheat to be compressed by medium temperature compressor 155. During post-startup, medium temperature compressor 155 compresses the refrigerant from load 130 after the refrigerant has been compressed by low temperature compressor 140. As a result, medium temperature compressor 155 compresses refrigerant that has already been compressed by low temperature compressor 140 during post-startup.

Oil separator 160 separates an oil from the refrigerant from medium temperature compressor 155. By separating the oil from the refrigerant, oil separator 160 prevents the oil from flowing to other components of system 100. If oil flows to these other components, the oil may damage and/or clog these other components. Thus, oil separator 160 improves the efficiency and lifespan of system 100. Particular embodiments of system 100, do not include oil separator 160.

In operation, system 100 cools a space proximate load 130 in two stages. In the startup stage, system 100 turns on heat exchanger 110, opens expansion valve 120, closes expansion valve 125, controls valve 135 to direct refrigerant away from low temperature compressor 140, turns off low temperature compressor 140, and turns on medium temperature compressor 155. High side heat exchanger 105 removes heat from a refrigerant and directs the refrigerant to heat exchanger 110. Heat exchanger 110 transfers heat away from the refrigerant from high side heat exchanger 105 and directs the refrigerant to flash tank 115. Flash tank 115 stores the refrigerant and directs the refrigerant to expansion valves 120 and 125. Because expansion valve 125 is closed and expansion valve 120 is open, the refrigerant passes through expansion valve 120 to load 130. Load 130 uses the refrigerant to cool load 130. The refrigerant from load 130 passes through valve 135 to heat exchanger 110, bypassing low temperature compressor 140. Heat exchanger 110 transfers the heat from the refrigerant from high side heat exchanger 105 to the refrigerant from load 130. Heat exchanger 110 then directs the refrigerant from load 130 to medium temperature compressor 155. Medium temperature compressor 155 compresses the refrigerant from load 130 and directs the refrigerant to oil separator 160. Oil separator 160 separates an oil from the refrigerant and directs the refrigerant to high side heat exchanger 105.

As load 130 uses the refrigerant to cool load 130, the temperature of load 130 falls. Sensor 133 monitors the temperature of load 130. When the temperature of load 130 falls below a certain temperature threshold, such as for example, 10 degrees Fahrenheit, system 100 transitions to a post-startup stage. During the transition, system 100 turns off heat exchanger 110, closes expansion valve 120, opens expansion valve 125, adjusts valve 135 to direct refrigerant to low temperature compressor 140, turns on low temperature compressor 140, and turns on desuperheater 145.

During the post-startup stage, high side heat exchanger 105 removes heat from the refrigerant and directs the refrigerant to heat exchanger 110. Heat exchanger 110 directs the refrigerant from high side heat exchanger 105 to flash tank 115. Flash tank 115 stores the refrigerant and directs the refrigerant to expansion valves 120 and 125. Because expansion valve 120 is closed and expansion valve 125 is open, refrigerant flows through expansion valve 125 to load 130. Load 130 uses the refrigerant to further cool load 130. Refrigerant from load 130 flows to valve 135. Valve 135 directs the refrigerant to low temperature compressor 140. Low temperature compressor 140 compresses the refrigerant from load 130. Desuperheater 145 removes heat from low temperature compressor 140. The refrigerant then flows to heat exchanger 110. Because heat exchanger 110 is turned off, no heat from the refrigerant from high side heat exchanger 105 transfers to the refrigerant from load 130. The refrigerant from load 130 passes through heat exchanger 110 to medium temperature compressor 155. Medium temperature compressor 155 compresses the refrigerant from low temperature compressor 140 and load 130. Oil separator 160 separates the oil from the refrigerant from medium temperature compressor 155 and directs the refrigerant to high side heat exchanger 105.

In this manner, system 100 protects low temperature compressor 140 from shutting down during the startup stage, when load 130 is at its warmest. After load 130 has been sufficiently cooled, system 100 turns on low temperature compressor 140 and allows low temperature compressor 140 to compress refrigerant from load 130. This disclosure contemplates any appropriate component of system 100 being turned off or on during startup and/or post-startup. Although certain components are described as being turned off or turned on during certain stages, this disclosure contemplates that these components may instead be turned on or turned off during these stages.

FIG. 2 illustrates an example cooling system 200. As seen in FIG. 2, system 200 includes a high side heat exchanger 105, a heat exchanger 110, a flash tank 115, an expansion valve 120, an expansion valve 125, a load 130, a sensor 133, a low temperature compressor 140, a desuperheater 145, a flash gas bypass valve 150, a medium temperature compressor 155, an oil separator 160, and a valve 205. In particular embodiments, system 200 protects low temperature compressor 140 from shutting down during startup by directing refrigerant from load 130 away from low temperature compressor 140 to medium temperature compressor 155. In this manner, low temperature compressor 140 is not tasked with compressing refrigerant that low temperature compressor 140 is not designed to compress.

Generally, several components of system 200 operate similarly as they did in system 100. For example, high side heat exchanger 105 removes heat from a refrigerant. Heat exchanger 110 transfers heat between refrigerant flowing through heat exchanger 110 during startup. Flash tank 115 stores a refrigerant. Expansion valves 120 and 125 cool refrigerant flowing through expansion valves 120 and 125. Load 130 uses refrigerant to cool a space proximate load 130. Sensor 133 monitors a temperature of load 130. Low temperature compressor 140 compresses refrigerant from load 130 during a post-startup phase. Desuperheater 145 removes heat from a refrigerant from low temperature compressor 140. Flash gas bypass valve 150 controls the flow of flash gas from flash tank 115 to medium temperature compressor 155. Medium temperature compressor 155 compresses refrigerant from load 130 during startup and refrigerant from low temperature compressor 140 during post-startup. Oil separator 160 separates an oil from the refrigerant from medium temperature compressor 155.

An important difference between system 200 and system 100 is valve 205. In system 100, a three-way valve 135 controlled the flow of refrigerant from load 130. In system 200, valve 205 also controls the flow of refrigerant from load 130. However, valve 205 may be a two-way valve such as, for example, a solenoid valve. During startup, valve 205 is opened to allow refrigerant from load 130 to flow through valve 205. Because low temperature compressor 140 is turned off during startup, refrigerant will not flow from load 130 to low temperature compressor 140. As a result, the refrigerant from load 130 flows through valve 205 to medium temperature compressor 155, bypassing low temperature compressor 140, during startup. During post-startup, valve 205 is closed to prevent refrigerant from load 130 from flowing through valve 205. Because low temperature compressor 140 is turned on during post-startup, refrigerant from load 130 flows through low temperature compressor 140. In this manner, a two-way valve, such as a solenoid valve, may be used in place of a three-way valve.

During startup, system 200 turns on heat exchanger 110, opens expansion valve 120, closes expansion valve 125, turns off low temperature compressor 140, opens valve 205, and turns on medium temperature compressor 155. High side heat exchanger 105 removes heat from a refrigerant and directs the refrigerant to heat exchanger 110. Heat exchanger 110 transfers heat away from the refrigerant from high side heat exchanger 105 and directs the refrigerant to flash tank 115. Flash tank 115 stores the refrigerant and directs the refrigerant to expansions valves 120 and 125. Because expansion valve 120 is open and expansion valve 125 is closed, refrigerant flows through expansion valve 120 to load 130. Load 130 uses the refrigerant to cool a space proximate load 130. Sensor 133 monitors the temperature of load 130. Refrigerant from load 130 flows through valve 205 to heat exchanger 110, bypassing low temperature compressor 140. Heat exchanger 110 transfers heat to the refrigerant from load 130 and directs the refrigerant to medium temperature compressor 155. Medium temperature compressor 155 compresses the refrigerant from heat exchanger 110 and load 130. Oil separator 160 separates an oil from the refrigerant from medium temperature compressor 155 and directs the refrigerant to high side heat exchanger 105.

Sensor 133 monitors the temperature of load 130. When the temperature of load 130 falls below a set temperature threshold such as, for example, 10 degrees Fahrenheit, system 200 transitions to a post-startup stage. During post-startup, system 200 turns off heat exchanger 110, closes expansions valve 120, opens expansion valve 125, closes valve 205, turns on low temperature compressor 140, and turns on desuperheater 145.

During post-startup, high side heat exchanger 105 removes heat from the refrigerant and directs the refrigerant to heat exchanger 110. Heat exchanger 110 directs the refrigerant to flash tank 115. Flash tank 115 stores the refrigerant and directs the refrigerant to expansion valves 120 and 125. Because expansion valve 120 is closed and expansion valve 125 is open, refrigerant flows through expansion valve 125 to load 130. Load 130 uses the refrigerant to further cool load 130. Because valve 205 is closed, refrigerant from load 130 flows to low temperature compressor 140. Low temperature compressor 140 compresses the refrigerant from load 130. Desuperheater 145 removes heat from the refrigerant from low temperature compressor 140. Medium temperature compressor 155 compresses the refrigerant from desuperheater 145 and/or low temperature compressor 140. Oil separator 160 separates an oil from the refrigerant from medium temperature compressor 155 and directs the refrigerant to high side heat exchanger 105. In this manner, system 200 protects low temperature compressor 140 from shutting down during startup by diverting refrigerant away from low temperature compressor 140 during startup.

This disclosure contemplates any appropriate component of system 200 being turned off or on during startup and/or post-startup. Although certain components are described as being turned off or turned on during certain stages, this disclosure contemplates that these components may instead be turned on or turned off during these stages.

FIG. 3 is a flowchart illustrating a method 300 of operating an example cooling system. In particular embodiments, various components of systems 100 and 200 perform the steps of method 300. As a result, a compressor is protected from shutdown during startup of the cooling system.

In step 305, a high side heat exchanger removes heat from a refrigerant. A flash tank stores the refrigerant in step 310. In step 315, it is determined whether the system is in a startup mode. The system may be in a startup mode if a temperature of a load is above a set temperature threshold such as, for example, 10 degrees Fahrenheit. This discloser contemplates the cooling system being in a startup mode at any suitable temperature.

If the system is in a startup mode, then a first expansion valve directs refrigerant from the flash tank to the load in step 320. In step 325, the load uses the refrigerant to cool a space. A heat exchanger transfers heat from the refrigerant from the high side heat exchanger to the refrigerant from the load in step 330. In step 335, a first compressor compresses the refrigerant.

If the system is not in a startup mode, then a second expansion valve directs refrigerant from the flash tank to the load in step 340. In step 345, the load uses the refrigerant to cool the space. A second compressor compresses the refrigerant from the load in step 350. In step 355, the first compressor compresses the refrigerant from the second compressor.

Modifications, additions, or omissions may be made to method 300 depicted in FIG. 3. Method 300 may include more, fewer, or other steps. For example, steps may be performed in parallel or in any suitable order. While discussed as systems 100 and/or 200 (or components thereof) performing the steps, any suitable component of systems 100 and/or 200 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the medium temperature compressor, the refrigerant from the low temperature compressor, the refrigerant from the flash tank, etc.). When such terminology is used, this disclosure is not limiting the described refrigerant to being directly from the particular component. This disclosure contemplates refrigerant being from a particular component (e.g., the high side heat exchanger, the medium temperature compressor, etc.) even though there may be other intervening components between the particular component and the destination of the refrigerant. For example, the heat exchanger receives a refrigerant from the medium temperature compressor even though there may be an oil separator between the heat exchanger and the medium temperature compressor.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a high side heat exchanger configured to remove heat from a refrigerant;

a heat exchanger;

a flash tank configured to store the refrigerant;

a first expansion valve;

a second expansion valve, wherein the second expansion valve is configured to reduce the temperature of a larger volume of refrigerant per unit time than the first expansion valve and to reduce the temperature of the refrigerant to a lower temperature than the first expansion valve;

a load, wherein the first expansion valve and the second expansion valve are disposed between the flash tank and the load;

a first compressor, and a second compressor, during a first mode of operation:

the first expansion valve is closed;

the second expansion valve directs refrigerant from the flash tank to the load;

the load uses the refrigerant from the second expansion valve to cool a space proximate the load;

the first compressor is off, the refrigerant from the load bypasses the first compressor;

the heat exchanger transfers heat from the refrigerant from the high side heat exchanger to the refrigerant from the load, the heat exchanger directs the refrigerant from the load to the second compressor after heat from the refrigerant from the high side heat exchanger is transferred to the refrigerant from the load; and the second compressor compresses the refrigerant from the heat exchanger;

during a second mode of operation:

the first expansion valve directs refrigerant from the flash tank to the load;

the second expansion valve is closed;

the load uses the refrigerant from the first expansion valve to cool the space;

the first compressor compresses the refrigerant from the load;

the refrigerant from the first compressor flows to the second compressor through the heat exchanger; and the second compressor compresses the refrigerant from the first compressor before the refrigerant from the first compressor reaches the high side heat exchanger.

2. The apparatus of claim 1, wherein the first mode of operation ends and the second mode of operation begins when a temperature of the space is below a threshold, wherein the threshold is 10 degrees Fahrenheit.

3. The apparatus of claim 1, wherein the load is a blast freezer.

4. The apparatus of claim 1, further comprising a desuperheater that, during the second mode of operation, removes heat from the refrigerant from the first compressor before the refrigerant from the first compressor reaches the second compressor.

5. The apparatus of claim 1, further comprising a valve that, during the first mode of operation, directs the refrigerant from the load to the heat exchanger bypassing the first compressor.

6. The apparatus of claim 5, wherein the valve is a three-way valve that, during the second mode of operation, directs the refrigerant from the load to the first compressor.

7. The apparatus of claim 1, further comprising an oil separator configured to separate an oil from the refrigerant from the second compressor.

8. A method comprising:

removing, by a high side heat exchanger, heat from a refrigerant;

storing, by a flash tank, the refrigerant;

during a first mode of operation:

directing, by a first expansion valve, refrigerant from the flash tank to a load;

using, by the load, the refrigerant from the first expansion valve to cool a space proximate the load, the refrigerant from the load bypasses a first compressor;

transferring, by a heat exchanger, heat from the refrigerant from the high side heat exchanger to the refrigerant from the load;

directing, by the heat exchanger, the refrigerant from the load to a first compressor after heat from the refrigerant from the high side heat exchanger is transferred to the refrigerant from the load; and compressing, by the first compressor, the refrigerant from the heat exchanger;

during a second mode of operation:

directing, by a second expansion valve, refrigerant from the flash tank to the load, wherein the second expansion valve is configured to reduce the temperature of a larger volume of refrigerant per unit time than the first expansion valve and to reduce the temperature of the refrigerant to a lower temperature than the first expansion valve, wherein the first expansion valve and the second expansion valve are disposed between the flash tank and the load;

using, by the load, the refrigerant from the second expansion valve to cool the space;

compressing, by a second compressor, the refrigerant from the load; and compressing, by the first compressor, the refrigerant from the second compressor before the refrigerant from the second compressor reaches the high side heat exchanger.

9. The method of claim 8, wherein the first mode of operation ends and the second mode of operation begins when a temperature of the space is below a threshold, wherein the threshold is 10 degrees Fahrenheit.

10. The method of claim 8, wherein the load is a blast freezer.

11. The method of claim 8, further comprising removing, by a desuperheater, during the second mode of operation, heat from the refrigerant from the second compressor before the refrigerant from the second compressor reaches the first compressor.

12. The method of claim 8, further comprising directing, by a valve, during the first mode of operation, the refrigerant from the load to the heat exchanger bypassing the second compressor.

13. The method of claim 12, further comprising, directing, by the valve, during the second mode of operation, the refrigerant from the load to the second compressor, wherein the valve is a three-way valve.

14. The method of claim 8, further comprising separating, by an oil separator, an oil from the refrigerant from the first compressor.

15. An apparatus comprising:

a high side heat exchanger configured to remove heat from a refrigerant;

a heat exchanger;

a flash tank configured to store the refrigerant;

a first expansion valve;

a second expansion valve, wherein the second expansion valve is configured to reduce the temperature of a larger volume of refrigerant per unit time than the first expansion valve and to reduce the temperature of the refrigerant to a lower temperature than the first expansion valve;

a load, wherein the first expansion valve and the second expansion valve are disposed between the flash tank and the load;

a valve;

a first compressor, and a second compressor, during a first mode of operation:

the first expansion valve is closed;

the second expansion valve directs refrigerant from the flash tank to the load;

the load uses the refrigerant from the second expansion valve to cool a space proximate the load;

the first compressor is off;

the valve directs the refrigerant from the load to the heat exchanger bypassing the first compressor;

the heat exchanger transfers heat from the refrigerant from the high side heat exchanger to the refrigerant from the load, the heat exchanger directs the refrigerant from the load to the second compressor after heat from the refrigerant from the high side heat exchanger is transferred to the refrigerant from the load; and the second compressor compresses the refrigerant from the heat exchanger;

during a second mode of operation:

the first expansion valve directs refrigerant from the flash tank to the load;

the second expansion valve is closed;

the load uses the refrigerant from the first expansion valve to cool the space;

the first compressor compresses the refrigerant from the load;

the refrigerant from the first compressor flows to the second compressor through the heat exchanger; and the second compressor compresses the refrigerant from the first compressor before the refrigerant from the first compressor reaches the high side heat exchanger.

16. The apparatus of claim 15, wherein the first mode of operation ends and the second mode of operation begins when a temperature of the space is below a threshold, wherein the threshold is 10 degrees Fahrenheit.

17. The apparatus of claim 15, wherein the load is a blast freezer.

18. The apparatus of claim 15, further comprising a desuperheater that, during the second mode of operation, removes heat from the refrigerant from the first compressor before the refrigerant from the first compressor reaches the second compressor.

19. The apparatus of claim 15, wherein the valve is a two-way valve that, during the second mode of operation, directs the refrigerant from the load to the first compressor.

20. The apparatus of claim 15, further comprising an oil separator configured to separate an oil from the refrigerant from the second compressor.

* * * * *